United States Patent [19]

Giguere

[11] Patent Number: 4,633,616

[45] Date of Patent: Jan. 6, 1987

[54] PATIO-DOOR UNIT

[75] Inventor: Jean-Paul Giguere, Lotbiniere, Canada

[73] Assignee: Donat Flamand Inc., Lotbiniere, Canada

[21] Appl. No.: 627,687

[22] Filed: Jul. 5, 1984

[51] Int. Cl.[4] ..... E05D 13/00

[52] U.S. Cl. ..... 49/425; 49/419; 49/421

[58] Field of Search ..... 49/425, 404, 419, 421, 49/429, 454, 455, 453, 438, 449

[56] References Cited

U.S. PATENT DOCUMENTS

| | | | |
|---|---|---|---|
| 1,977,975 | 10/1934 | Schuler | 49/454 |
| 2,317,312 | 4/1943 | Swanson et al. | 49/449 X |
| 2,371,724 | 3/1945 | Young | 49/425 X |
| 2,638,639 | 5/1953 | Carter | 49/421 |
| 3,698,883 | 10/1972 | Fazio | 49/449 |

FOREIGN PATENT DOCUMENTS

| | | | |
|---|---|---|---|
| 7510444 | 12/1975 | Netherlands | 49/419 |

*Primary Examiner*—Kenneth Downey

*Attorney, Agent, or Firm*—Cushman, Darby & Cushman

[57] ABSTRACT

A system of sliding doors commonly called patio-doors, having a wooden structure and well adapted for a household use. This device comprises a wooden rectangular frame receiving two glazed panels, one of which is sliding. The latter is supported on its lower portion by rollers. In the upper portion of the movable panel, the guiding system is constituted by a spring-loaded runner, preferably a channel whose two flanges extend into two parallel grooves on the top of the slidable panel. To remove the sliding panel from the frame supporting it, the operator lowers the retractable runner; this releases the upper portion of the panel from the frame and allows it to swing outwardly. A safety device is provided to prevent accidental removal of the upper portion of the sliding panel from the frame. Also described is a patio-door unit comprising two sets of glazed panels, each having one sliding panel.

11 Claims, 5 Drawing Figures

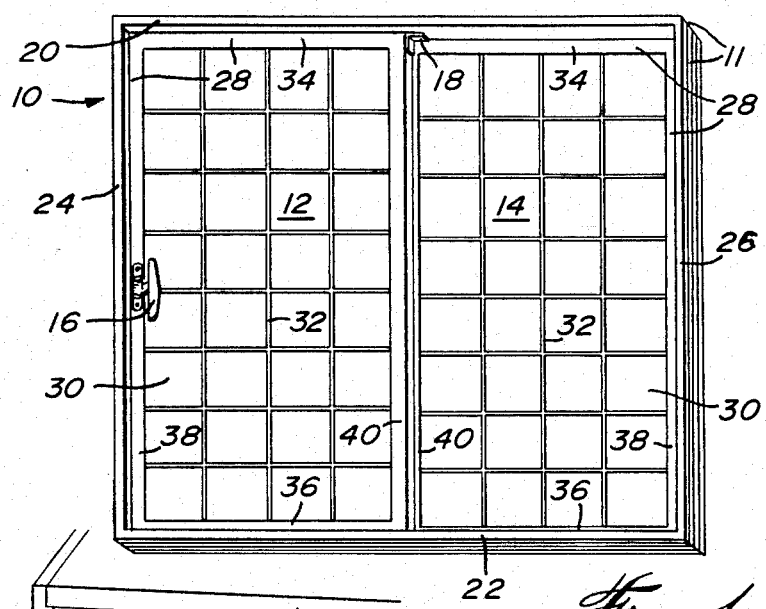
Fig. 1
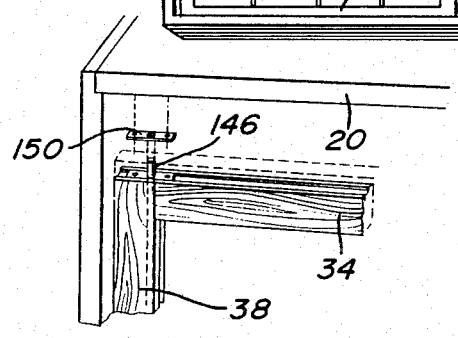
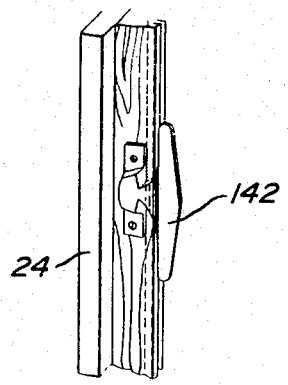
Fig. 4
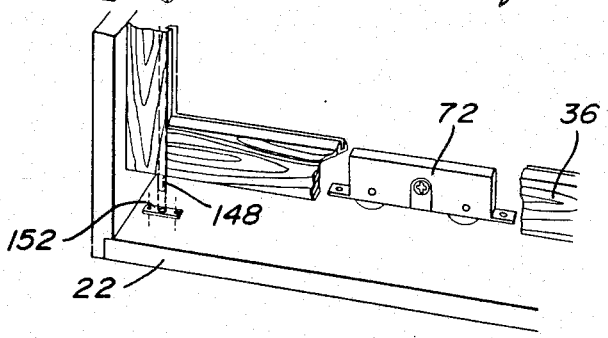

PATIO-DOOR UNIT

The present invention relates to sliding doors and more particularly patio-doors made of wood, adapted for domestic use and delivered as a factory assembled unit.

Wooden patio-door or system of conventional design normally comprises a wooden rectangular frame in which are mounted panels having a wooden structure and carrying a suitable glazing unit, either a single glass pane or a sealed double or triple glazing unit. Such patio-doors are generally made of relatively soft wood such as pine or cedar, which implies large tooling-tolerances. Nevertheless, factory-made and assembled patio doors must operate properly, be simple and economical to manufacture and easy to maintain and install.

A serious shortcoming of prior patio-doors is the difficulty encountered when removing the sliding panel. In most cases, the operator must firstly lift the panel to disengage it from the lower track supporting it, and then lower it to disengage it from the upper track to release it from the frame. This operation may be difficult and dangerous since the panel is heavy and large. This weight is further increased when double or triple glazing is used. Another problem associated with this device is that to lift the panel, a dead space in the upper portion of the frame must be provided which not only contributes to air infiltration but adds an undesirable thickness to the lintel portion of the frame.

One of the objects of this invention is to provide a wooden factory-assembled patio-door unit, the sliding panel of which may be easily removed with the least possible danger for the user.

Another object of this invention is to provide such a patio-door unit which provides an excellent protection against the elements from the standpoint of air infiltration and thermal insulation and which affords the use of a lintel, the upper section of which is relatively thin as compared to the existing ones.

Another object of this invention is to provide such a patio-door unit which may easily be mass-produced from soft wood and which is easy to install and maintain.

According to the present invention, these objects are achieved by using a retractable runner mounted on the upper portion of the sliding panel and running in a groove or slideway made on the stationary crosspiece or lintel of the door frame. This mechanism confines the upper portion of the sliding panel and allows it to slide. The runner is retractable in the top rail of the panel so that to remove the latter, it suffices to retract the runner into its seat until it disengages from the groove of the upper crosspiece or lintel of the frame. The upper portion of the sliding panel may then swing outwardly while the sliding panel remains on the lower track.

Such an arrangement requires only a small dead space in the lintel of the frame and it provides a good thermal insulation as excellent protection against air infiltration even in slightly warped installations.

Thus, the factory-assembled patio door unit, according to this invention, comprises a wooden, rectangular frame in which are mounted two or more panels, at least one of which is sliding. The device for supporting, guiding and sliding the sliding panel comprises a first mechanism, of known construction, comprising rollers and a track, installed between the sill and the bottom rail of the sash of the sliding panel; the second mechanism is constituted by an elongated retractable runner carried on the top rail of the sliding panel sash and of a corresponding slideway or groove in the lintel of the frame, the slideway system being constituted by a retractable elongated runner mounted on the top rail on the sliding panel and extending upwardly, and by a corresponding slideway on the lintel receiving the retractable runner which is held in extended position by resilient drawback means.

In a typical embodiment of the invention, the factory-assembled patio-door unit comprises two double glazed panels, one sliding and one stationary, and a screened sliding panel. Alternative embodiments may have a pair of single glazed storm panels added to the main panels which are single or multiple glazed panels depending on the required degree of thermal insulation.

These and other features and modifications of the present invention will become apparent from the following detailed description of a preferred embodiment of the invention with reference to the accompanying drawings wherein:

FIG. 1 is a perspective view of a factory-assembled patio-door unit according to this invention;

FIG. 4 is a perspective view of portions of the frame and of the sliding panel of a patio-door unit provided with a lock.

Figure 2:
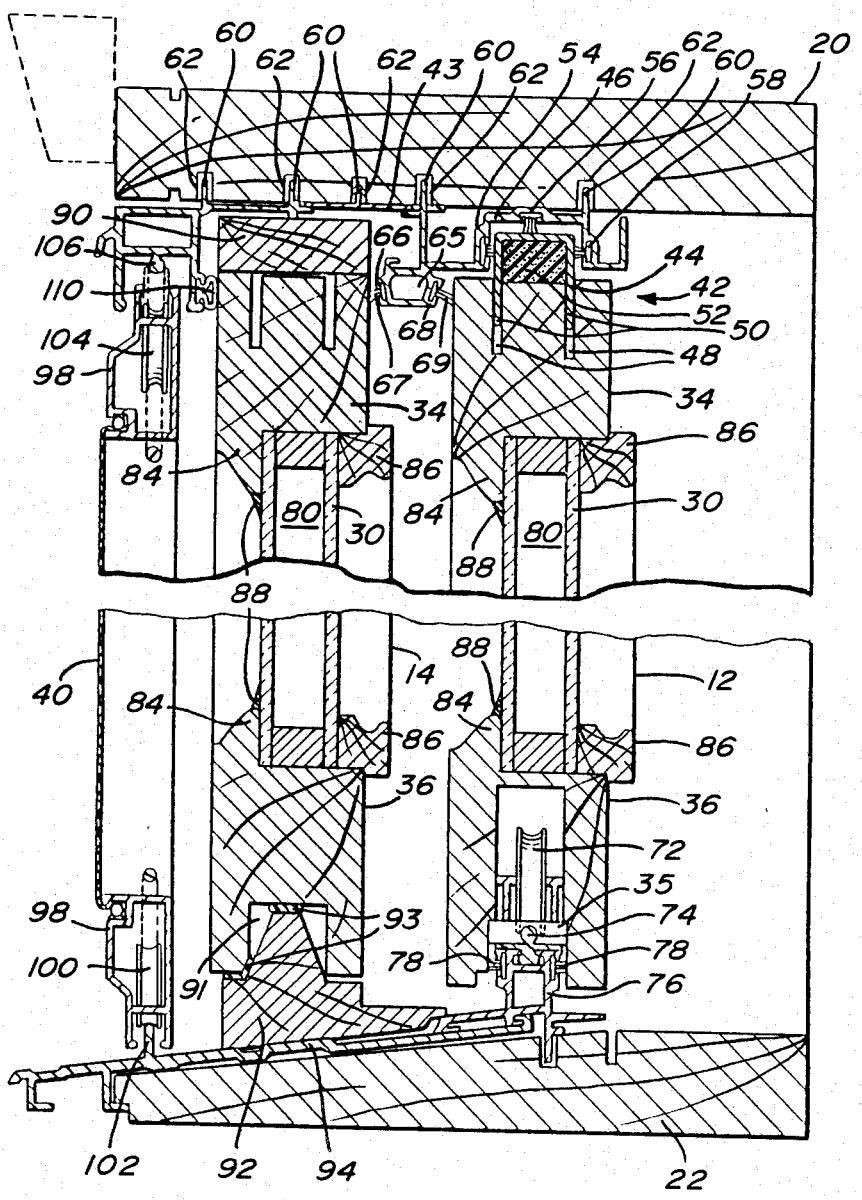
FIG. 2 is a vertical sectional view of the factory-assembled patio door unit illustrated in FIG. 1.

The factory-assembled patio-door 10 shown in FIGS. 1 through 5 comprises a wooden rectangular frame 11, two glazed panels 12 and 14 having wooden sashes, a lock 16 on sliding panel 12 and a safety device 18 which prevents unwanted removal of sliding panel 12 as will be more fully described hereinafter.

Frame 11 is made of a lintel 20, a supporting crosspiece or sill 22, a right jamb 24 and a left jamb 26. As is well known, frame 11 defines a rigid rectangular structure within which sliding panel 12 can slide.

Panels 12 and 14 shown in FIG. 1 are made of a wooden sash 28 carrying a suitable glazing 30. It consists of a top rail 34, a bottom rail 36 and two lateral stiles, outer stile 38 and inner stile 40. A decorative grille 32 may be used to give the appearance of glazing formed of small individual glass panes. The glazing may be single but in regions where the climate is too harsh, sealed multiple glazing such as double and even triple glazing may be used.

Referring to FIG. 2, sliding panel 12 is retained to frame 11, by means of two mechanisms. the mechanism which allows the upper portion of this panel to slide is generally indicated by the reference 42. It is constituted by two elements, a retractable runner 44 and a receiving groove 46. Runner 44 is preferably a channel extrusion whose length is equal to the width of the sash of the sliding panel 12. Channel 44 is held to the top rail 34 by means of two parallel slots 48 receiving the two parallel arms 50 of the channel 44.

The space between the top rail 34 and channel 44 is advantageously filled with a compressible resilient material 52 acting as a drawback spring to keep the runner 44 in an extended position. This resilient material may be foam rubber for example. The latter has also the advantage to be a good thermal insulator.

Runner 44 is tiltable in the plane of sliding panel 12 against the drawback spring constituted by compressible material 52. When the lintel 20 and the sill 22 of the patio-door are slightly out of parallelism, a defect which may result from a faulty installation or from a warping of the frame of the patio-door unit attributable to dampness, runner 44 will compensate for the misalignment by inclining itself and it will remain parallel with lintel 20 and tightly engaged in groove 46 during the movement of the sliding panel allowing a good thermal insulation.

The groove 46 extends lengthwise on the lintel 22 and weather strips, made with polyethylene filaments, mounted in jaws 54, 56 and 58 may be installed. These imperviousness means are very efficient even when the frame 11 is slightly warped.

The groove 46 is preferably a depression in an elongated plate 43 of plastic material attached to the wooden lintel 20 by means of ribs 60 inserted in notches 62. Rubber fins 64 on the ribs 60 retain the elongated plate 43 to the lintel 20. A tubular element 65 is provided in the space formed between the panels 12 and 14 and, on the opposite sides of this hollow element, jaws 66 and 68 receiving weather strips 67 and 69 are provided. The weather strip 67 is mounted in front of the stationary panel 14, and the weather strip 69 extends lengthwise on the sliding panel 12.

The sliding panel 12 comprises in its lower portion a device 35 which allows it to slide with the least posible resistance. This device is constituted by rollers 72 (see FIG. 4) moving on a track 74 mounted on a plate 76, preferably made of aluminum and seated on the sill 22. The upwardly extending projection of the plate 76 comprises two weather strips 78 extending toward the internal walls of the bottom rail 36.

The glazing 30 of each panel 12 and 14 is preferably a sealed double glazing 80, however this is only a question of a design depending on the atmospheric conditions. The glazing 30 is mounted in the frame of each panel between a shoulder 84 and a molding strip 86. A suitable plastic sealer 88 may be used.

To remove the sliding panel 12 from the frame 11, it suffices to retract the runner 44 in the grooves 48 when the sliding panel is in open position. The sliding panel 12 may then be disengaged by pulling it outwardly. Usually it suffices to lower the outer edge of the runner 44 and at the same time to pull the upper portion of the outer stile 38 to firstly disengage the corresponding upper edge of the sliding panel 12 followed by its top rail 34. Secondly, the sliding panel 12 must be lowered, whose weight is still supported by rollers 72 or the track 74.

The stationary panel 14 as shown in FIG. 2 has basically the same construction as the sliding panel 12. It is held in place by a tenon 92 screwed on a water bar 94 of the sill 22. The tenon 92 is inserted in a groove 91 made in the bottom rail 36 which is screwed on the tenon 92 (before the installation of the glazing is made).

The top rail 34 is also screwed to the frame 11, and if needed, a shim 90 may be used. Suitable plastic sealer may be used, as for example between the runner 92 and the bottom rail 36 as indicated by the reference numeral 93. The glazing is subsequently mounted in its frame and held by a moulding strip 86.

A weather-strip 110 may be provided between the stationary panel 14 and the plate 43 of the lintel. Such a weather strip is very efficient and provides a good pimerviousness even when the frame 1 is slightly warped.

The screen panel 40 is of known construction. It comprises a frame 98 mounted on rollers 100 and 104 guided on opposite tracks 102 and 106. The track 102 is integral with the water bar 94 and the track 106 is integral with the plate 43.

Figures 3, 5:
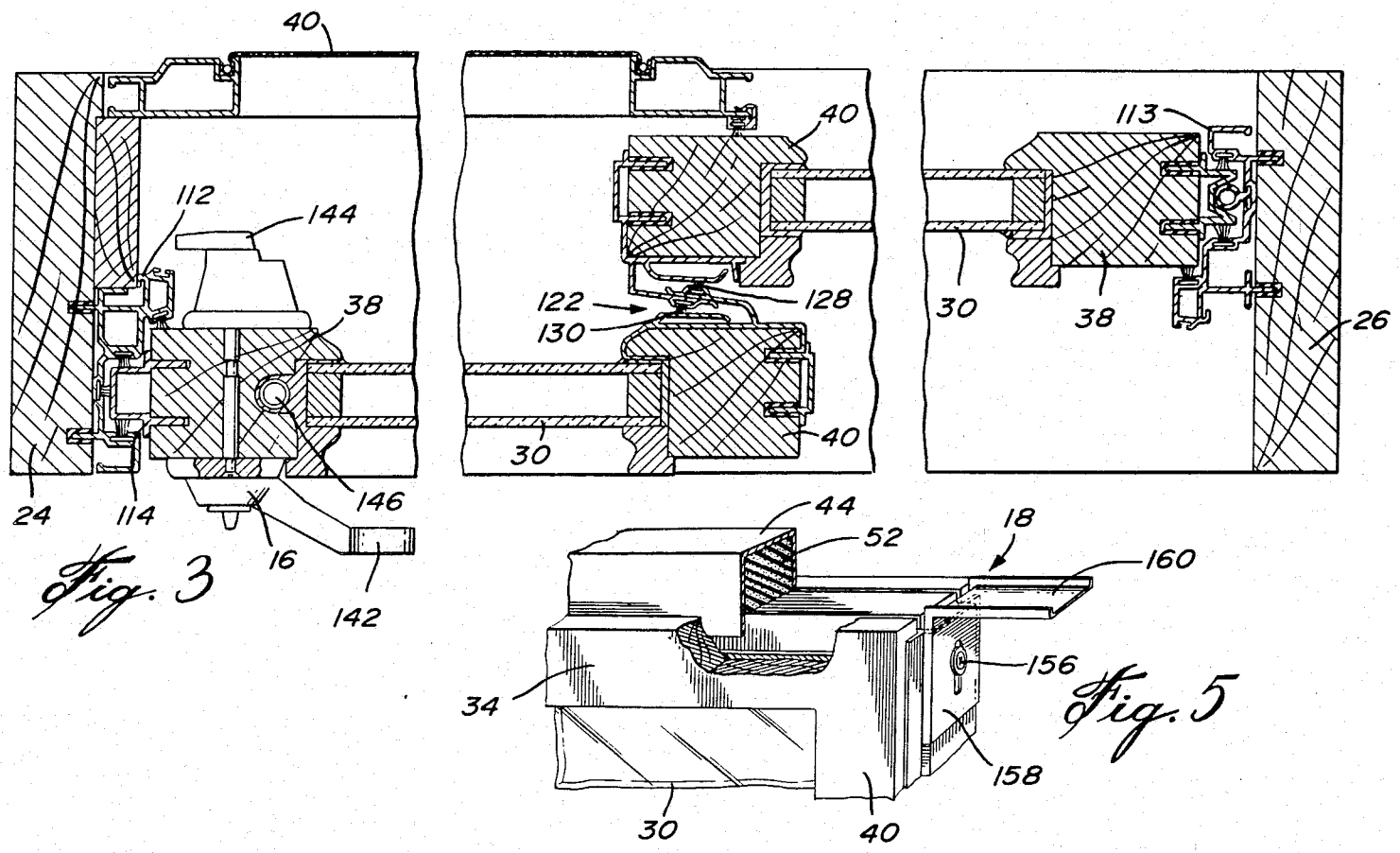
FIG. 3 is a horizontal sectional view of the same factory-assembled patio door unit.
FIG. 5 is a partial perspective view of a corner of a sliding panel.

Referring now to FIG. 3 which is a horizontal sectional view of the factory-assembled patio door unit 10, as illustrated in FIG. 1, one may see a moulding 112 on the jamb 24 against which bears the sliding panel 12. This moulding 112 forms a groove provided with a weather-strip and receives a tenon 114 attached on the outer stile 38 of the sliding panel 12.

At the junction of the inner stiles 40 of the panels 12 and 14, a nesting joint 122 may be provided, which is achieved by using weather-strips 128, 130 made with polyethylene filaments.

The imperviousness between the outer stile 38 of the stationary panel 14 and the jamb 26 is achieved by a device 113 identical to the mouldings 112 and 114.

The cremon bolt 16 as illustrated in FIG. 3 comprises a inner handle 142 and an outer handle 144 on the outer stile. Two locking rods 146 and 148 (see FIG. 4) are inserted in respective box staples 150 and 152 to lock the door when in closed position. The box staples 150 and 152 are installed respectively in the groove 46 and on the track 74 by means of screws (not shown). An opening should be provided in the runner 44 to accommodate the rod 146.

FIG. 5 illustrates a safety device 18 which prevents any accidental removal of the runner 44 from the groove 46. This device 18 is constituted by a square 154, one of its arms being attached on the inner stile 40 with a screw 156 in a slot 158. In locking position, the horizontal arm 160 penetrates the groove 46 and prevents an unwanted removal of the panel 12 from the groove 46. To remove the sliding panel 12, firstly the strip 154 must be lowered by untightening slightly the screw 156.

The invention will now be defined in the following claims.

The embodiments of the invention in which an exclusive property or privilege is claimed are defined as follows:

1. A patio door unit, comprising:

a wooden, substantially rectangular frame defined by a jamb on each side, a lintel joining the two jambs on their upper extremities, and a sill joining the two jambs on their lower extremities;

at least two glazed panels with wooden sashes, one of said panels is sliding in said frame, the sliding panel laying in a plane, each panel comprising a sash constituted by two stiles, a top rail joining two stiles on their upper extremities and a bottom rail joining said two stiles on their lower extremities; and a guiding and supporting device allowing said sliding panel to move by lateral translation inside said frame, and substantially parallely to the lintel and to the sill of said frame, said device comprising at the base of the sliding panel a roller system mounted between the bottom rail of the sliding panel and the sill of said frame and comprising rollers installed on a track in such a way as to reduce the displacement resistance of the sliding panel; said guiding and supporting device further comprising a slideway system at the top of the sliding panel, said slideway system allowing the sliding of the upper portion of said sliding panel relatively to the lintel and also allowing said sliding panel to be removed from said frame, the slideway system being constituted by a retractable elongated runner mounted on the top rail on the sliding panel and extending upwardly, and by a corresponding slideway on the lintel receiving the retractable runner which is held in extended position by resilient drawback means, said elongated runner being tiltable against said resilient drawback means in the plane of said sliding panel in order to remain parallel with said lintel during the sliding of said sliding panel when said lintel is not strictly parallel with said sill.

2. A patio-door unit as defined in claim 1, wherein said retractable runner is a moulding having a constant cross-section and which length is substantially the same than the one of said sliding panel.

3. A patio-door unit as defined in claim 2, wherein said moulding is a channel moulding whose two arms are retractable into spaced grooves, longitudinal and parallel made on the top rail of the sash of said sliding panel.

4. A patio-door unit as defined in claim 3, wherein said resilient drawback means are constituted by a strip of foam rubber of a suitable density and which fills substantially all the space comprised between said moulding and the top rail which supports it when said moulding is in extended position.

5. A patio-door unit as defined in claim 4, wherein said slideway system further comprises an imperviousness means extending between the slideway and the runner when the latter is in extended position.

6. A patio-door unit as defined in claim 5 wherein said imperviousness means comprise a weatherstrip mounted on each vertical wall of said slideway.

7. A patio-door unit as defined in claim 6, wherein said sliding panel is provided with a cremonbolt, comprising:

a handle attached on the outer stile of the sash of the sliding panel;

a pair of vertical locking rods concealed in said outer stile of said sash, a box staple mounted on the lintel and a box staple mounted on the sill, said box staples being adapted to receive the locking rods of said cremon-bolt when said sliding panel is in closed position, said retractable runner having an opening to accommodate the upper vertical locking rod.

8. A patio-door unit as defined in claim 1 wherein said sliding panel is provided with a safety device preventing an unwanted removal of said sliding panel comprising a square having an arm attached with screws on the upper edge of the inner stile of the frame of the sliding panel locking the other arm in extended position in such a way that it penetrates said slideway.

9. A patio-door unit comprising:

a wooden, substantially rectangular frame defined by a jamb on each side, a lintel joining the two jambs on their upper extremities, and a sill joining the two jambs on their lower extremities;

a least two glazed panels with wooden sashes, one of said panels is sliding in said frame, the sliding panel laying in a plane, each panel comprising a sash constituted by two stiles, a top rail joining said two stiles on their upper extremities and a bottom rail joining said two stiles on their lower extremities; and a guiding and supporting device allowing said sliding panel to move by lateral translation inside said frame, and substantially parallelly to the lintel and to the sill of said frame, said device comprising at the base of the sliding panel a roller system mounted between the bottom rail of the sliding panel and the sill of said frame and comprising rollers mounted on a track in such a way as to reduce the displacement resistance of the sliding panel; said guiding and supporting device further comprising a slideway system at the top of the sliding panel, said slideway system allowing the sliding of the upper portion of said sliding panel relatively to the lintel and also allowing said sliding panel to be removed from said frame, said slideway system being constituted by a retractable elongated runner constituted by a moulding mounted on the top rail on said sliding panel and being extended upwardly, by a corresponding slideway on the lintel and receiving said retractable runner and by an imperviousness means constituted by weather strips made of polyethylene filaments extending between the slideway and the retractable runner when the latter is in extended position, said retractable runner being held in extended position by resilient drawback means, said elongated runner being tiltable against said resilient drawback means in the plane of said sliding panel in order to remain parallel with said lintel during the sliding of said sliding panel when said lintel is not strictly parallel with said sill.

10. A patio-door unit as defined in claim 3 wherein said sliding panel is provided with a safety device preventing an unwanted removal of said sliding panel comprising a square having an arm attached with screws on the upper edge of the inner stile of the frame of the sliding panel locking the other arm in extending position in such a way that it penetrates said slideway.

11. A patio-door unit as defined in claim 7 wherein said sliding panel is provided with a safety device preventing an unwanted removal of said sliding panel comprising a square having an arm attached with screws on the upper edge of the inner stile of the frame of the sliding panel locking the other arm in extending position in such a way that it penetrates said slideway.

* * * * *